11/2/82 4,357,562

United States Patent [19]

Strouk

[11] 4,357,562

[45] Nov. 2, 1982

[54] DEVICE FOR AUTOMATICALLY SELECTING THE SPEED OF A SELF-PROPELLING MOVING BODY

[75] Inventor: Gilbert Strouk, Le Pecq, France

[73] Assignee: FATA S.A., France

[21] Appl. No.: 168,474

[22] Filed: Jul. 14, 1980

[30] Foreign Application Priority Data

Jul. 23, 1979 [FR] France ..... 79 18946

[51] Int. Cl.[3] ..... B60T 7/18

[52] U.S. Cl. ..... 318/135; 318/38; 318/587; 104/292; 246/66

[58] Field of Search ..... 246/66, 69; 318/135, 318/587, 38, 490; 104/292

[56] References Cited

U.S. PATENT DOCUMENTS 3,506,823 4/1970 Failor ..... 246/66

3,817,344 6/1974 Asano et al. ..... 318/587

3,835,950 9/1974 Asano et al. ..... 318/587

*Primary Examiner*—B. Dobeck

*Attorney, Agent, or Firm*—Stevens, Davis, Miller & Mosher

[57] ABSTRACT

The present invention comprises two control lines parallel to a rail for guiding self-propelling moving bodies. These lines are divided into sections in staggered relationship between which portions of conductor are placed. Sliding contacts, connected to the moving body, travel over the control lines to detect the state of voltage of one and to short circuit the other. A relay reverses the detection and the short circuit on passage of the sliding contacts on each of the portions of conductor. The invention is applicable to the field of handling.

6 Claims, 1 Drawing Figure

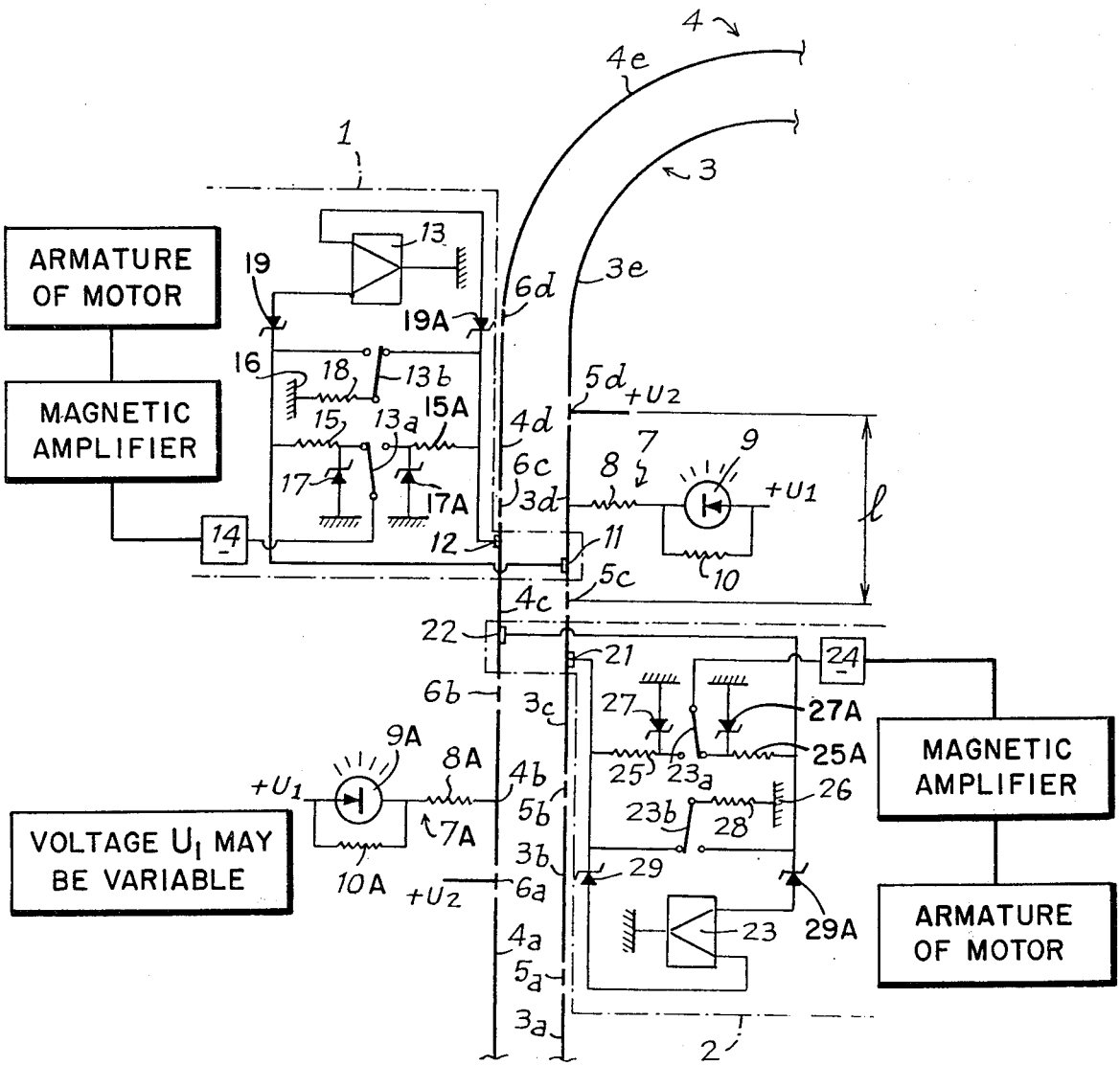
ARMATURE OF MOTOR
MAGNETIC AMPLIFIER
VOLTAGE $U_1$ MAY BE VARIABLE
MAGNETIC AMPLIFIER
ARMATURE OF MOTOR
+U1
+U2
1
2
3
4
3a
3b
3c
3d
3e
4a
4b
4c
4d
4e
5a
5b
5c
5d
6a
6b
6c
6d
7
7A
8
8A
9
9A
10
10A
11
12
13
13a
13b
14
15
15A
16
17
17A
18
19
19A
21
22
23
23a
23b
24
25
25A
26
27
27A
28
29
29A
l

DEVICE FOR AUTOMATICALLY SELECTING THE SPEED OF A SELF-PROPELLING MOVING BODY

The present invention relates to a device for automatically selecting the speed of a self-propelling moving body.

In the field of conveying, particularly aerial conveying, it is known to transport the loads by means of balancelles which are suspended from a rail by means of one or more carriages guided by this rail. These carriages may, at least as far as some of them are concerned, be self-propelling and therefore carry the load or, in another type of installation, simply be provided with means for connection to non-bearing, self-propelling moving bodies traveling over a separate rail parallel to the rail guiding said carriages over at least a part of its length.

In either case, the speed of each self-propelling body must be servo-controlled or means must be provided for automatically regulating it as a function of the presence or absence of a self-propelled body preceding it within a predetermined distance. Thus, it is known that the self-propelling bodies are animated by a high speed, if the space in front of them is free, or a low speed if a self-propelling body is present within the above-mentioned distance. In fact, the preceding self-propelling body may either be traveling itself at low speed and a collision must be avoided, or may have stopped on the way due to breakdown or for storage purposes and a high speed collision must be prevented. Low speed is determined so that there is possibility of collision, therefore of accumulation of movable bodies on a section of rail. The means for braking, stopping and restarting each self-propelling body are also known.

The means for changing speed of a self-propelling body generally consist of a conducting line running along the above-mentioned rail which carries information indicating the presence or absence of a self-propelling body in front of it within the specified distance. Each self-propelling body therefore has a device for reading this control line reacting at the output on the motor of the moving body and a device emitting a signal in said line or modulating a pre-existing signal.

The present invention relates to a particularly simple and reliable installation for effecting this read-out and emission of signal.

To this end, it has for its object a device for automatically selecting the speed—between a low and a high speed—of a self-propelling moving body circulating on a guide, as a function of the presence or absence of a moving body preceding it on the guide within a predetermined distance.

According to one of the main features of the invention, this device is constituted by:

two electrically conducting control lines extending along the guide, each of them being divided into sections of length equal to double the above-mentioned predetermined distance, the sections of one being in staggered relationship with respect to the sections of the other, the stagger being equal to said length, first means for taking each of said sections to a determined potential, portions of conductors of short length with respect to that of the sections interposed on each line between two consecutive sections, second means for taking said portions of conductor to a determined potential substantially higher than the potential of said sections, and a device for exploiting the potentials of said control lines fast with the self-propelling moving body, comprising two contacts sliding on each of the control lines which are, on the one hand, connected to a bistable relay for controlling two contacts and, on the other hand, connected to the input of a device for controlling the speed of the self-propelling body for one of them and short circuiting for the other, by means of said contacts for a first state of the relay, the electrical connection of the sliding contacts being reversed for a second state of the relay, the change of state of the relay being controlled on passage of one or the other of the sliding contacts on each of the portions of conductors mentioned above.

In a first application of the invention, the first means mentioned above produce a fixed voltage corresponding to a high speed of the fixed self-propelling body.

In a second application, the first means mentioned above produce a variable voltage corresponding to a variable high speed of the self-propelling body.

It will be advantageous if the device for controlling the speed of the self-propelling body is constituted by the control winding of a magnetic amplifier connected to the armature of the motor of the self-propelling body.

In addition, certain sections—and in particular the sections disposed along a curve of the conveying path—of each control line cannot be supplied.

Finally, a pilot will have been provided for detecting the state of short circuit of each section which, connected to each section, will be placed in a control room wherein the functioning of the installation is monitored.

The invention will be more readily understood on reading the following description with reference to the accompanying drawings, in which:

The single FIGURE schematically illustrates an embodiment of the invention.

Referring now to the drawing, two self-propelling mobile bodies, shown very schematically in dashed and dotted lines, are referenced 1 and 2. These mobile bodies travel in direction A along a single rail (not shown).

The path defined by this rail is visualized in this FIGURE by two control lines 3 and 4 parallel to said rail. Each of these control lines 3 and 4, therefore running along the rail, is divided into sections 3*a* to 3*d* and 4*a* to 4*d* of equal lengths l. This length is chosen as being double a predetermined minimum distance which must separate two consecutive moving bodies so that the following moving body may travel at high speed. In the curve, the control lines may also comprise sections of the same length or, as shown, a single conductive 4*e*, 3*e* according to the modalities of control or of regulation of the speed of the self-propelling bodies which will have been chosen. The sections 3*a*–3*d* are arranged in staggered relationship with respect to sections 4*a*–4*d*. The value of the stagger is equal to said predetermined distance.

Between each consecutive section, portions of conductors, 5*a* to 5*d* for line 3 and 6*a* to 6*d* for line 4, which are small with respect to the sections, have been disposed. The distance separating two portions consecutively encountered by a moving body during its travel is therefore equal to said predetermined distance.

Each of the above-mentioned sections is taken to a voltage $U_1$ as illustrated solely for sections 3*d* and 4*b*.

On the supply lines 7, 7*a* of each section there will have been placed resistors 8, 8*a* in series with pilot lamps 9, 9*a* (electroluminescent) at the terminals of which resistors 10, 10*a* are mounted to deviate the current, so that the pilot lamps light up only when each section is short-circuited as explained hereinafter. In addition, each of the portions of conductors 5*a*–5*d*, 6*a*–6*d* is taken to a voltage $U_2$ as shown opposite portions 5*d* and 6*a*. The voltage $U_2$ is substantially higher than voltage $U_1$ (for example double).

Each self-propelling moving body comprises a device for exploiting the voltages carried by the control lines 3 and 4 or, more precisely, by each of their sections and portions of conductor. For the moving body 1, this device is constituted by two sliding contacts 11 and 12 electrically connected to the inputs of a bistable relay 13 for controlling two rocking contacts 13*a* and 13*b*. In a first position, i.e. in a first state of the relay, the contact 13*a* ensures the electrical connection of the sliding contact 12 with a device 14 for controlling the speed of the self-propelling body. This control device may in particular comprise the control winding of a magnetic amplifier whose output is connected to the armature of the electric motor of the moving body.

Resistors 15, 15*a* are placed on the respective lines of connection of the sliding contact 12 to the contact 13*a* and Zener diodes 17, 17*a* are conventionally placed so that a predetermined fixed potential, for example substantially $U_1$, prevails at contact 13*a* level.

In this same state of the relay 13, the contact 13*b* ensures the electrical connection of the sliding contact 11 with earth 16 through a resistor 18. The value of this resistor is a function in particular of the value of the resistors 8, 8*a* (and of the circuit elements including pilot lamps 9, 9*a* and resistors 10, 10*a* ) so that, when the short circuit is effected, the potential of the sliding contact 11 is of the order of a few volts (2 or 3).

In a second state of the relay 13 (the one shown), the contact 13*a* establishes the electrical connection of the sliding contact 11 with the device 14 through a line bearing a resistor 15 and on which is connected a Zener diode 17 as described previously, whilst the contact 13*b* connects the sliding contact 12 to earth 16 through the resistor 18. It will have been noted that the lines of connection of the sliding contacts 11 and 12 to the relay 13 also comprise Zener diodes 19, 19*a* in series with the winding of the relay. Each diode possesses a voltage threshold below which it is not conducting. This threshold will be chosen to be at least equal to $U_1$.

The same elements are found in the moving body 2, referenced in the same order from 21 to 29.

The functioning of the moving body 1 will firstly be considered, it being assumed that there is no moving body in front of it. As shown in the FIGURE, the sliding contact 11 is connected to the device 14 whilst the sliding contact 12 short circuits the section of control line 4*c*. Thus, the voltage of the section 3*d* is introduced into device 14. This voltage is, to within a few volts, voltage $U_1$ in view of the high impedance of the device 14 with respect to that of the elements of the line 7. The motor of the moving body is then at high speed until the portion of conductor 6*c* is reached. The sliding contact 12 receives a voltage $U_2$ upon its passage over 6*c* and, through the diode 19, a voltage $U_2$-$U_1$ reaches the winding of the relay 23 and causes it to change state. At this moment, the section 3*d* is short circuited through the resistor 18 whilst the section 4*d* is electrically connected to the device 14 which therefore always receives a voltage substantially equal to $U_1$ and the moving body continues its travel at high speed. Of course, the device 14 comprises electronic elements for the cut-off corresponding to the rocking of the relay not to react on the control of the motor.

The sliding contact 11 will then reach the portion of conductor 5*d*. The relay 13 receiving the voltage $U_2$-$U_1$ rocks again and the section 3*e* will be electrical connection with the device 14, whilst the section 4*d* is short circuited.

The section 3*e* is a curved section and it is advantageous, from the point of view of security, if the moving bodies travel over the curves at low speed. To obtain this result, the sections 3*e* and 4*e* are not supplied. Thus, the voltage received by the device 14 is zero and the moving body passes at low speed. It will remain at low speed even after the relay has rocked upon passage of the sliding contact 12 over the portion of conductor 6*d*. At the end of the curve, a new section taken to voltage $U_1$ will have been provided on line 3 and the moving body may reach its maximum speed.

It will have been noted that the voltage $U_2$ may reach the contact 13*a* and the device 14. This phenomenon is avoided by the resistors 15, 15*a* and the Zener diodes 17, 17*a* which ensure a potential at contact 13*a* which is never higher than the threshold of the diodes 17, 17*a* i.e. substantially $U_1$.

The functioning of the moving body 2 is identical to that of the moving body 1. In the case of the FIGURE, it is seen that the moving body 2 is in contact with the section 4*c* of the control line 4, similarly to moving body 1. Now, it has been seen above that said section 4*c* is short-circuited, i.e. at a potential of a few volts. It follows that the device 24 for controlling the speed of the moving body 2 receives only these few volts, therefore that the speed of this moving body is low. When the moving body 1 has passed the portion of conductor 6*c*, the section 4*c* finds its potential $U_1$ again which is transmitted to the device 24 and the moving body 2 passes at high speed. After the portion of conductor 5*c*, the device 24 receives the voltage carried by the conductor 3*d* which will be $U_1$ if the moving body 1 is either between the portions 5*c* and 6*c*, which is impossible in view of the preceding situation, or beyond 5*d*, or which will be a few volts if the moving body 1 is between the portions 6*c* and 5*d*.

The embodiment described hereinabove employs voltages $U_1$ and $U_2$ such that $U_1$ may be 24 volts and $U_2$ 48 volts. It may be imagined that $U_2$ is zero in which case the relay 23 would drop at each end of section and would be energized consecutively in one direction then in the other for the establishment and maintenance of its two states by the consecutive sections. Such an embodiment which comes within the scope of the invention has virtually been set aside as it presents too many operational risks. The one described is preferred, in which the relay 23 rocks under the effect of a pulse and conserves its state by mechanical or magnetic locking.

Without departing from the scope of the invention, it may also be imagined that the voltage $U_1$ is no longer fixed but variable and, in particular, servo-controlled by the displacement of another moving body. Thus, for example, if the moving bodies 1 and 2 belong to an aerial conveyer, it may be advantageous if, over a certain length, their speed is identical to that of carriages belonging to a conveyor on the ground cover which the aerial conveyor passes, over said length. In this case, the ground conveyor would emit the above-mentioned voltage $U_1$ in proportion to its speed. In the case envisaged of a device 24 constituted by the control winding of a magnetic amplifier associated with the armature (or the inductor) of the motor of the moving bodies, it is known that the voltage applied to the control winding directly determines the output voltage of the amplifier, therefore the speed of the motor.

Finally, the moving bodies equipped with the device according to the invention will comprise safety systems in the case of breakdown due to lack of electrical supply or any immobilisation. Thus, any moving body in stopped position will have a member for short-circuiting the two control lines 3 and 4, thus avoiding a moving body, stopped on the adjacent end of two consecutive sections and for which the relay had not rocked, being stuck by another moving body at high speed.

The device according to the invention is very advantageous regarding safety and monitoring of the functioning of the installation, its versatility of use and simplicity of execution.

It finds advantageous application in the field of handling.

The invention is not limited to the description which has just been given, but covers on the contrary all the variants which may be made thereto without departing from its scope.

What is claimed is:

1. A device for automatically selecting the speed between a low speed and a high speed of a self-propelling moving body circulating on a guide as a function of the presence or absence of a moving body preceding it on the guide within a predetermined distance, said device comprising:

two electrically conducting control lines extending along the guide, each being divided into sections of length equal at the most to double the predetermined distance, the sections of one being placed in staggered relationship with respect to the sections of the other, the stagger being equal to said length, first means for taking each of said sections to a determined potential, portions of conductors of short length with respect to that of the sections interposed on each line between two consecutive sections, second means for taking said portions of conductor to a determined potential substantially higher than the potential of said sections, and a device for exploiting the potentials of said control lines fast with the self-propelling moving body comprising two contacts sliding on each of the control lines which are firstly connected to a bistable relay for controlling two contacts and secondly connected to the input of a device for controlling the speed of the self-propelling body for one of them and short-circuiting for the other, by means of said contacts for a first state of the relay, the electrical connection of the sliding contacts being reversed for a second state of the relay, the change of state of the relay being controlled on passage of one or the other of the sliding contacts on each of the said portions of conductors.

2. The device of claim 1, wherein the first means produce a fixed voltage corresponding to a high speed of the fixed self-propelling body.

3. The device of claim 1, wherein the first means produce a variable voltage corresponding to a variable high speed of the self-propelling body.

4. The device of claim 1, wherein the device for controlling the speed of the self-propelling body comprise a control winding of a magnetic amplifier connected to the armature of the motor of the self-propelling body.

5. The device of claim 1, wherein certain of said sections of each control lines are not supplied.

6. The device of claim 1, wherein a pilot lamp for detecting the state of short circuit of each section is connected to each section of each control line.

* * * * *